United States Patent [19]

Scharf et al.

[11] 4,183,442

[45] Jan. 15, 1980

[54] CONTAINER CLOSURE HAVING PULL-TAB OPENING MEANS

[75] Inventors: Jerry F. Scharf, Havertown, Pa.; Vinson S. Potts, Cherry Hill, N.J.

[73] Assignee: Crown, Cork & Seal Company, Inc., Philadelphia, Pa.

[21] Appl. No.: 589,018

[22] Filed: Oct. 24, 1966

[51] Int. Cl.[2] ..... B65D 41/32

[52] U.S. Cl. ..... 220/271

[58] Field of Search ..... 220/57, 54, 48, 266–274; 215/46; 222/541

[56] References Cited

U.S. PATENT DOCUMENTS

| | | | |
|---|---|---|---|
| 3,301,432 | 1/1967 | Novak | 220/54 |
| 3,322,296 | 5/1967 | Khoury | 220/48 |
| 3,326,406 | 6/1967 | Brown | 220/54 |
| 3,338,463 | 8/1967 | Henrickson | 220/54 |

*Primary Examiner*—George T. Hall

*Attorney, Agent, or Firm*—Cushman, Darby & Cushman

[57] ABSTRACT

A container closure having a tear strip opener wherein the removable panel which is defined by a primary score line includes a secondary score line and a pull tab which is secured to the removable panel at the collar portion formed by the primary and secondary score lines. The pull tab extends transversely with respect to the primary and secondary score lines and a lifting of the free end of the tab will rupture the secondary score line and initiate rupture of the primary score line and twist the collar portion to facilitate subsequent rupture of the primary score line.

6 Claims, 11 Drawing Figures

Fig. 5.
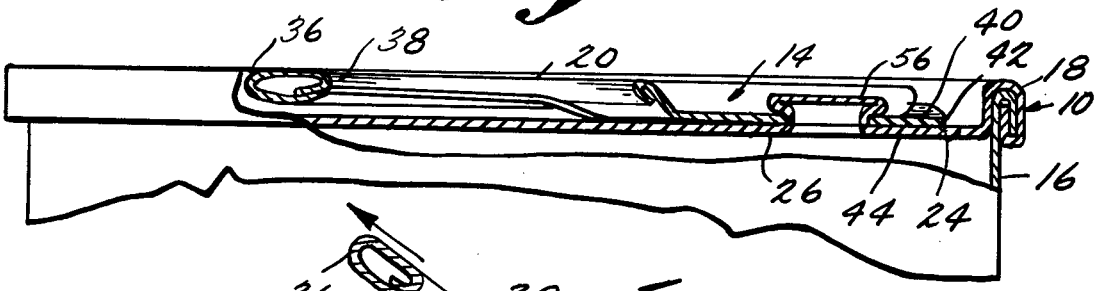
Fig. 7.
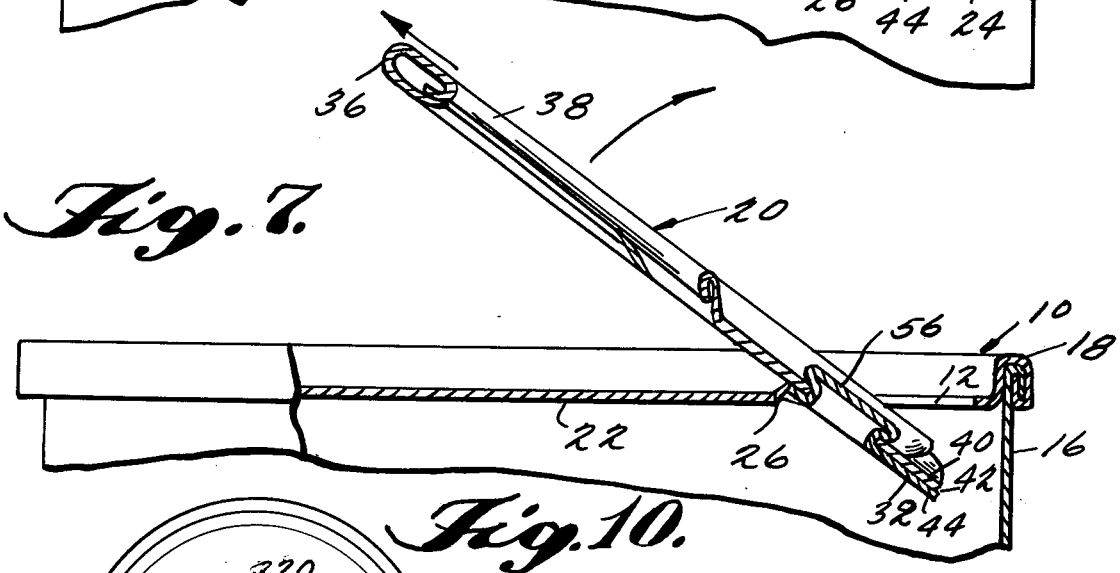
Fig. 10.
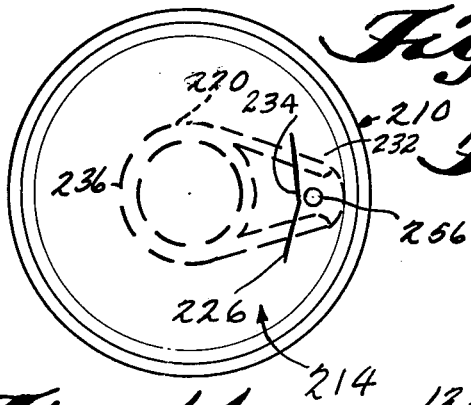
Fig. 8.
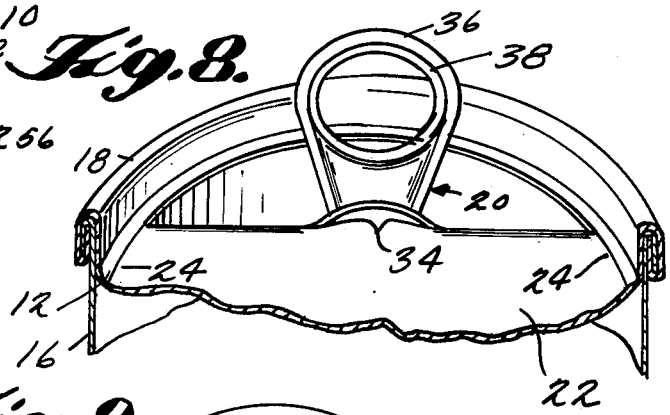
Fig. 11.
Fig. 9.
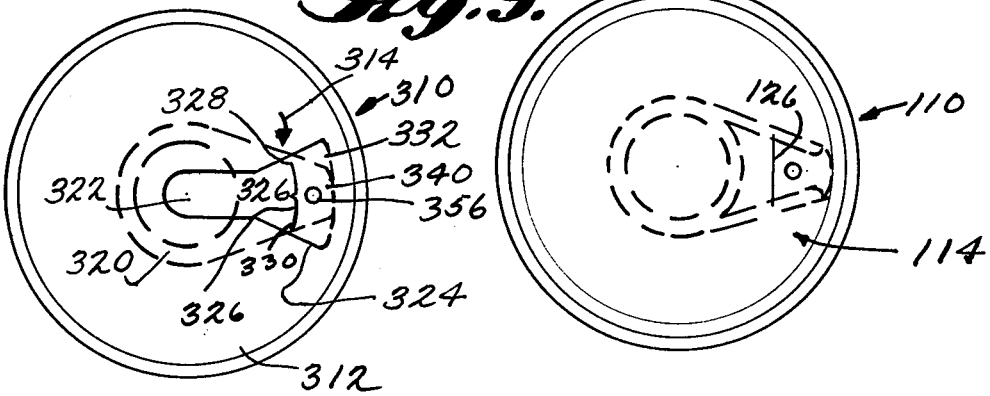

CONTAINER CLOSURE HAVING PULL-TAB OPENING MEANS

This invention relates generally to container closures and more particularly to an improved closure having a tear strip opener.

Closures having a tear strip opener or a pull tab opener, as they are frequently known, of the type contemplated by the instant invention are utilized to form an end wall of sealed containers or cans which are commonly employed to contain liquid, semi-solid or flowable products.

Such closures having a tear strip opener generally comprise an end wall forming portion of a container, such as a conventional can, having a generally planar surface provided with a line of weakness such as a score line, defining an area of the end wall known as a tear strip, which is to be removed to form a dispensing opening. The tear strip or removable area is provided with a small key or pull tab terminating at one end in a free end portion adapted to be gripped by the fingers of a user and at the opposite end in a fulcrum portion. Intermediate its free and fulcrum end portions the pull tab is secured to the tear strip by suitable means, such as by an integral rivet-like formation in the tear strip which is mechanically interlocked about the defining edge of an aperture formed in the pull tab. The pull tab thus forms a handle-like member to be gripped by the user to effect rupture of the closure material along the score line and thereby sever the tear strip from the closure wall to produce an opening in the end wall of the container or can. While sealed containers provided with closures having such tear strip openers have found increasing usage and have enjoyed considerable commercial acceptance, several difficulties have been encountered in their use by the ultimate consumer. Such difficulties have quite naturally resulted in a reluctance among consumers to readily accept and employ the tear strip opener rather than employing conventional can opening devices. Thus, a frequent source of annoyance and resulting consumer aversion to tear strip openers has been the considerable force and consequent effort necessary to cause both the initial and subsequent progressive rupture of the closure material along the score line. The necessity of applying such considerable force to the pull tab in order to effect initial and progressive rupture along the score line is undesirable not only because of the difficulty experienced by the user in opening the container but also because the pull tab will frequently separate from the tear strip without effecting desired rupture of the closure material along the score line. Such unintentional separation or detachment of the pull tab from the tear strip commonly occurs at the beginning of the opening operation when the pull tab is lifted to effect initial rupture along the score line and, of course, renders the tear strip opener inoperative.

Moreover, prior art tear strip type closure constructions, particularly those wherein the area of the tear strip constitutes substantially the entire end wall of the closure, are frequently such that the disposition of the portion of the tear strip severed by the initial lifting of the pull tab to initiate rupture of the score line is unfavorable for the subsequent progressive rupture of the remaining intact portion of the score line required to effect complete severance of the tear strip from the closure. Thus, after initial rupture of the score line of such prior art tear strip closure constructions, the user is frequently obliged to exert variously directed distorting forces upon the pull tab and tear strip in order to effect complete rupture along the score and severance of the tear strip from the closure. The imposition of such variously directed forces upon the pull tab and tear strip not only imposes an inconvenience upon the user, but also results in the imposition of undesirable stresses upon the connection of the pull tab and tear strip as well as an undesirable deformation and contortion of the tear strip itself which can result in a rupture or breaking of the tear strip before it has been completely severed from the closure. Obviously, it is therefore desirable that a tear strip closure be such that the tear strip can be completely severed and removed therefrom by simple natural movements of the user, such as by a lifting and pulling of the pull tab, which require only a minimum of effort.

Furthermore, the greater the effort necessary to effect initial rupture along the score line, the stronger and more rigid must be the pull tab and its connection to the tear strip. Thus, reduction of the effort necessary to effect intial rupture along the score line is also obviously desirable since the pull tab and the closure wall, from which the integral rivet-like tab connection means is formed, can be formed of lighter gauge, and thus less expensive, material.

Accordingly, it is a principal object of the present invention to provide an improved closure having a tear strip opener.

Another object of the present invention is to provide an improved container closure having a tear strip opener which can be easily opened by the average person.

A still further object of the present invention is to provide an improved container closure having a tear strip opener wherein a minimum effort is necessary to effect initial rupture of the preformed score line.

Another object of the present invention is to provide an improved container closure having a tear strip opener wherein the likelihood of separation of the pull tab from the tear strip during opening of the closure is reduced.

Still another object of the present invention is to provide an improved container closure having a tear strip opener which can be easily opened by the average person by simple natural movements which require only a minimum of effort.

A further object of the present invention is to provide an improved container closure having a tear strip opener which can be readily opened by a simple lifting and pulling of a pull tab secured to the tear strip.

Another object of the present invention is to provide an improved container closure having a tear strip opener wherein severance of the tear strip is initiated by simply lifting a pull tab secured thereto and the initially severed portion of the tear strip is disposed so as to facilitate the subsequent progressive rupture of the closure material along the remaining intact portion of the score line.

Other objects and the entire scope of the present invention will become apparent from the following detailed description and by reference to the accompanying drawings. It should be understood, however, that the detailed description and specific examples, while indicating preferred embodiments of the invention, are given by way of illustration only, since various changes and modifications within the spirit and scope of the invention will become apparent as the description herein progresses.

Reference is now being made to the accompanying drawings, which form a part hereof, wherein:

FIG. 5 is a sectional view taken along the line 5—5 of FIG. 1;

FIG. 7 is a sectional view taken along the line 7—7 of FIG. 5;

FIG. 8 is a fragmentary perspective view of the partially opened closure shown in FIGS. 6 and 7;

FIG. 9 is a top plan view of a modified form of the present invention;

FIG. 10 is a top plan view illustrating another modified form of the present invention; and FIG. 11 is a top plan view illustrating still another modified form of the present invention.

Figure 1:
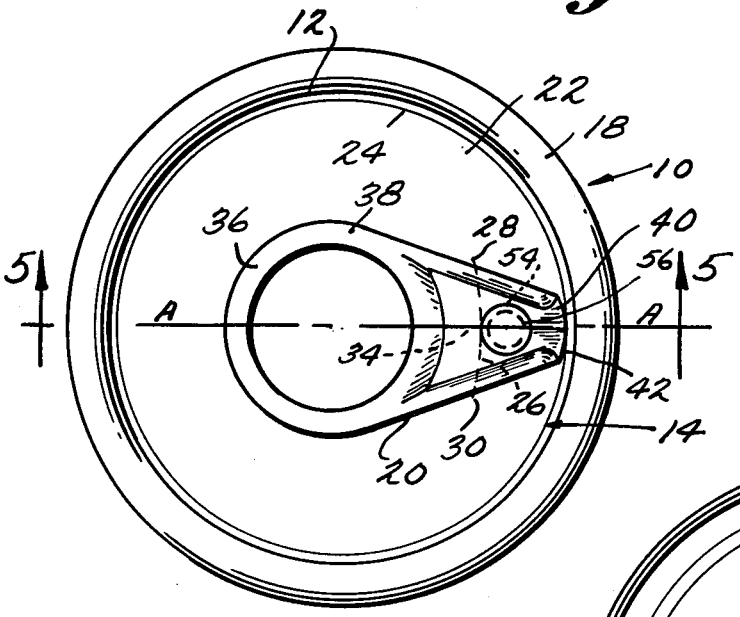
FIG. 1 is a top plan view of a container closure having a tear strip opener embodying the present invention.

Referring now to FIGS. 1, 2, 3, 4, and 5 of the drawings, there is shown a container closure 10 formed of a suitable material, preferably an aluminum alloy, having a flexible, substantially flat or planar end wall forming portion 12 provided with a tear strip opener 14. The flexible planar end wall 12 will be seen to be disc shaped, and is adapted to form one end wall of cylindrical container or can 16 of the type commonly employed in the marketing of liquid or semi-solid materials or other consumer products, such as frozen juices or the like. As is well known, the outer circular edge or rim of the closure 10 is provided with an annular bead or flange 18 adapted to effect a sealed juncture between the closure 10 and the cylindrical side wall of the container 16 so as to form an end wall thereof.

Figure 2:
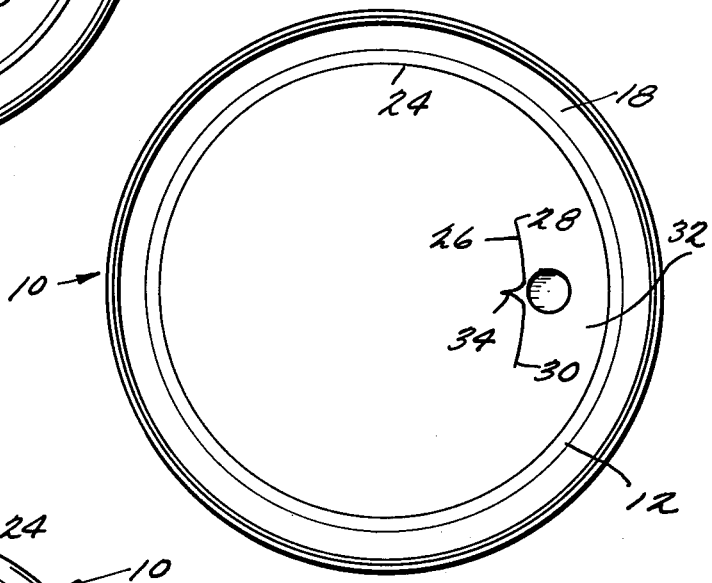
FIG. 2 is a top plan view of the container closure shown in FIG. 1 before assembly of the pull tab thereto.

The tear strip opener 14 comprises an elongated pull tab 20 having a transversely centered longitudinal axis A—A and an opening pattern or tear strip 22 defined by an endless line of reduced metal thickness or primary score line 24 formed in the planar disc-like end wall 12 of the closure 10. As best seen in FIGS. 1 and 2, the primary score line 24 is of a circular configuration and is formed closely adjacent the annular peripheral bead 18 so that the tear strip 22 defined thereby comprises a removable disc-shaped area which constitutes substantially the entire end wall of the closure 10. Of course, as will be evident hereinafter, the removable area of the closure wall which is defined by the endless primary score line need not constitute the entire end wall of the closure, but rather can constitute only a segment thereof and can also be of any desired non-circular configuration.

The tear strip 22 also includes a secondary line of reduced metal thickness or score line 26 of limited extent formed radially inwardly of the endless primary score line 24. The secondary score line 26 will be seen to extend generally transversely with respect to the longitudinal axis A—A of the pull tab 20 and terminate in opposed terminal ends 28 and 30, respectively, radially inwardly of the primary score line 24 so as to define a tear strip collar portion 32 therebetween. Preferably, the secondary score line 26 has a slightly arcuate configuration, as best seen in FIGS. 1 and 2, which is generally convex towards the collar portion 32. In addition, the secondary score line 26 can include a discontinuity or interruption in the form of a relatively sharp rupture stress concentrating apex or junction 34 formed by angularly intersecting portions of the secondary score line 26 intermediate the opposed ends 28 and 30 thereof. The relatively sharp score line junction 34, which will be seen to be in vertical alignment with the longitudinal axis A—A of the pull tab 20, acts as a point of rupture stress concentration to reduce the lifting effort which must be applied to the pull tab to initiate removal of the tear strip 22 from the closure 10, as will be described more fully hereinafter.

Figure 3:
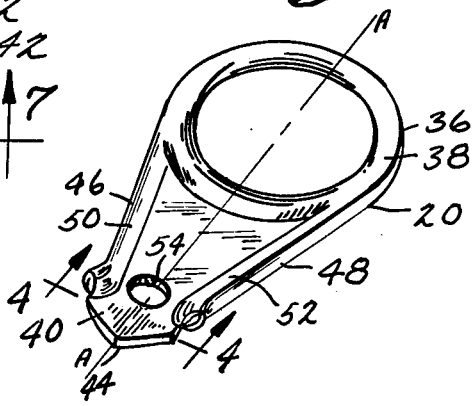
FIG. 3 is a perspective view of the pull tab utilized on the closure shown in FIG. 1.
Figure 4:
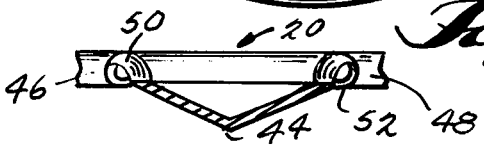
FIG. 4 is a sectional view taken along the line 4—4 of FIG. 3.

The pull tab 20, which is also preferably formed of a suitable metal such as aluminum, has a generally elongated configuration and includes an enlarged free end handle portion 36 preferably in the form of ring 38 adapted to be gripped by the fingers of a user, and a fixed end fulcrum portion 40. Preferably, the inner and outer edges of the ring 38 are smooth and rounded so as to be free of any sharp edges which might inflict injury on a user gripping the pull tab 20 during an opening operation. The opposed fixed end fulcrum portion 40 terminates in a slightly arcuate end edge 42 which overlies a segment or portion of the primary score line 24. In order to increase the rigidity of the fulcrum portion 40 as well as to facilitate initial rupture of the primary score line 24 by concentrating the rupture force applied to the tear strip 22 through the pull tab 20 along a line or narrow area, the fulcrum portion 40 is provided with a short longitudinally extending depressed bearing rib 44 as best seen in FIGS. 3 and 4. The rib 44, which can be conveniently formed by simply bending or slightly creasing the fulcrum portion 40 of the pull tab 20 on its longitudinal axis A—A, provides a relatively narrow bearing surface which engages the underlying collar portion 32 of the tear strip when the free end portion 36 of the pull tab 20 is lifted.

In addition, the substantially straight longitudinally extending side edges 46 and 48, which will be seen to converge as they extend from the free end portion 36 to the fulcrum end portion 40 of the pull tab 20, can each be provided with a strengthening bead or rib 50 and 52, respectively. Such ribs 50 and 52 provide the pull tab 20 with added rigidity so that it will effectively resist transverse bending during opening of the closure, and can be conveniently formed by hemming or folding the marginal edge portion edge of the tab inwardly upon itself.

At the fulcrum end 40 the pull tab 20 is provided with a suitable aperture 54, through which an integral rivet-like formation 56, formed in the collar portion 32 of the tear strip 22 closely adjacent to the secondary score line 26, extends to mechanically interlock and thereby operatively secure the pull tab 20 to the tear strip 22. As best seen in FIG. 1, the pull tab 20 is disposed such that the longitudinal axis A—A thereof extends radially with respect to both the primary score line 24 and the secondary score line 26. In addition, as best seen in FIG. 5, the pull tab 20 will thus be face wisely engaged with the outer surface of the tear strip 22 and will not interfere with normal stacking of the containers 16 for shipment and display.

Figure 6:
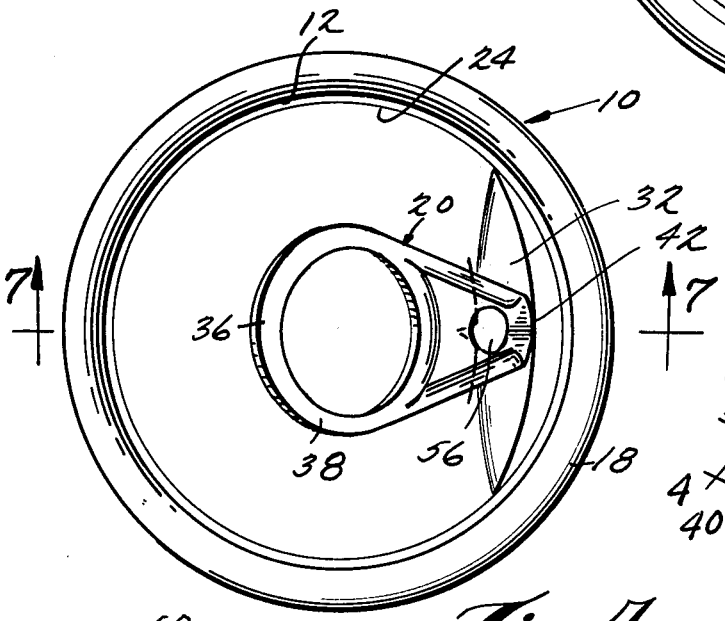
FIG. 6 is a top plan view of a container closure having a tear strip opener embodying the present invention with the tear strip partially severed from the closure.

To remove the tear strip 22 and thereby create an opening in the closure 10 for the discharge of the container contents, the ring 38 at the free end portion 36 of the pull tab 20 is gripped and lifted or raised from the underlying surface of the closure end wall 12. As the free end 36 of the pull tab 20 is lifted, the secondary score line 26 and the portion of the primary score line 24 adjacent the fulcrum portion 40 of the tab will rupture and the collar portion 32 of the tear strip 22 defined thereby will twist sharply out of the plane of the end wall 12, as shown in FIGS. 6, 7, and 8. The sharp angle of entry of the severed collar portion 32 to which the pull tab 20 is secured permits the primary score line 24 to be progressively and completely ruptured to sever the tear strip 22 from the closure 10 by simply pulling the tab away from the closure 10.

The initial lifting of the free end portion 36 of the pull tab 20 causes an upwardly directed score line rupturing force to be applied through the integral rivet-like formation 56 to the portion of the collar 32 adjacent the secondary score line 26 as the fulcrum portion 40 simultaneously bears on, and applies a downwardly directed score line rupturing force to the portion of the collar 32 adjacent the outer primary score line 24. The rupture of the inner secondary score line 26 which occurs immediately before, or substantially simultaneously with, the intial rupture of the primary score line 24 reduces the effort necessary to effect such initial rupture of the primary score line 24 (as compared to the lifting effort which would be required to effect initial rupture of the primary score line 24 if the secondary score line were not provided) and assures optimum orientation of the initially severed portion of the tear strip 22 for effecting the complete severance thereof from the closure 10 by simply pulling the pull tab 20 away from the closure 10.

Referring now to FIG. 9 of the drawings, there is shown a modified form of container closure 110 having a tear strip opener 114 embodying the present invention. The construction of the tear strip opener 114 of the closure 110 differs from the tear strip opener 14 just described in that the inboard or secondary score line 126 comprises a substantially straight line terminating in opposed terminal end portions 128 and 130 radially inwardly of the primary peripheral score line 124. In addition, the secondary score line 126 does not include a stress concentrating apex intermediate its opposed end portions. The operation of the tear strip opener 114 is, however, substantially as previously described with reference to the tear strip opener 14.

Referring now to FIG. 10 of the drawings, there is shown another modified form of a container closure 210 having a tear strip opener 214 embodying the present invention. The construction of the tear strip opener 214 of the closure 210 differs from that of the tear strip opener 14 previously described in that the secondary score line 226 is formed by two straight line portions which diverge as they extend away from their apex or juncture at 234 adjacent the integral rivet-like formation 256 toward the free end 236 of the pull tab 220 so as to be generally convex toward the collar portion 232.

Referring now to FIG. 11 of the drawings, there is shown another modified form of a closure 310 having a tear strip opener 314 embodying the present invention. The construction of the tear strip opener 314 of the closure 310 differs from that of the tear strip opener 14 of the closure 10 aforedescribed in that the endless primary score line 324 is of a non-circular configuration and the removable area or tear strip 322 defined thereby constitutes only a segment of the closure end wall 312. The secondary score line 326 formed in the tear strip 322 is substantially identical to the secondary score line 26 previously described in connection with the tear strip opener 14, and terminates in opposed ends 328 and 330 inwardly of the periphery of the tear strip 322 defined by the primary score line 324. As was the case with the other embodiments of the invention previously described herein, the secondary score line 326 and the radially outwardly adjacent portion of the primary score line 324 define a relatively narrow collar portion 332 to which the fulcrum end 340 of the pull tab 320 (shown in broken lines) is attached by an integral rivet-like formation 356 formed in the tear strip 322.

It will thus be seen that the objects of this invention have been fully and effectively accomplished. It will be realized, however, that the foregoing specific embodiments have been shown and described only for the purpose of illustrating the principles of this invention and are subject to extensive change without departure from such principles.

We claim:

1. A container closure having a peripheral bead for attaching the closure to the end of a container; said closure further having a flexible generally planar disc surrounded by said peripheral bead and adapted to overlie the end of the container to which it is attached, said flexible disc having a first material thickness reducing score defining a predetermined opening pattern and a second material thickness reducing score formed to lie radially inwardly of said first score to define a collar between said scores, said second score having two substantially straight score line portions intersecting adjacent an opening tab; an opening tab including a fulcrum portion terminating adjacent said first score and a handle portion; and means securing said fulcrum portion to said collar at a point adjacent said second score to cause the axis of said tab to lie radially of both scores; said score and tab arrangement responding to a lifting of the tab handle portion to fracture said second score and thereby permit said collar to twist out of the plane of said disc to permit a sharp angle of entry as the fulcrum end of said tab fractures said first score, said arrangement further permitting said first score to be fractured along its entire length in response to a pull on the handle portion of said tab directed away from said closure.

2. A container closure having a tear strip opener in a flat planar container wall forming portion thereof comprising in combination a primary endless score line formed in said wall portion defining a tear strip; a secondary score line formed in said tear strip and terminating in terminal end portions spaced inwardly of said primary score line so as to define a collar portion between said primary and secondary score lines, said secondary score line having two substantially straight score line portions intersecting adjacent an elongated pull tab; an elongated pull tab including a handle portion at one end and a fulcrum portion at the other end; and means connecting and securing said fulcrum portion of said pull tab to said collar adjacent said secondary score line so that the longitudinal axis of said pull tab extends transversely with respect to said secondary score line and the terminal end of said fulcrum portion of the pull tab is disposed adjacent a portion of said primary score line whereby lifting of the handle portion of said pull tab will effect rupture of said secondary score line, initiate rupture of said primary score line and twist the collar portion out of the plane of said wall so as to facilitate the subsequent progressive rupture of said primary score line to sever said tear strip from said wall and thereby produce an opening in said closure.

3. In an easy-opening container wall, the combination of:

a scoreline in the container wall defining a rupturable web in the container wall, said rupturable web defining a wall segment at least partially removable from the container wall;

a longitudinally rigid tab for initiating removal of the wall segment from the container wall, said tab having a lifting portion and a rupturing portion;

interconnecting means for attaching said tab intermediate said portions thereof to said wall segment with the reupturing portion lying closely adjacent said rupturable web whereby movement of said lifting portion of said tab away from the container wall forces said rupturing portion toward the container wall; and a line of weakness in said wall segment, said line of weakness having end portions spaced from said first rupturable web, said line of weakness having two substantially straight score line portions intersecting adjacent said interconnecting means securing said tab, said interconnecting means lying between at least a portion of said line of weakness and said rupturable web whereby movement of said handle portion of said tab away from the container wall stresses and ruptures the container wall along said line of weakness to provide an aperature in said wall segment to facilitate continued movement of said handle portion of said tab, such continued movement of the handle portion causing said rupturing portion to initiate severance of said wall segment from the container wall along said rupturable web.

4. A container closure having a peripheral bead for attaching the closure to the end of a container; said closure further having a flexible generally planar disc surrounded by said peripheral bead and adapted to overlie the end of the container to which it is attached, said flexible disc having a first material thickness reducing score defining a predetermined opening pattern and a second material thickness reducing score formed to lie radially inwardly of said first score to define a collar between said scores, said end portions of said second score being turned away from an opening tab; an opening tab including a fulcrum portion terminating adjacent said first score and a handle portion; and means securing said fulcrum portion to said collar at a point adjacent said second score to cause the axis of said tab to lie radially of both scores; said score and tab arrangement responding to a lifting of the tab handle portion to fracture said second score and thereby permit said collar to twist out of the plane of said disc to permit a sharp angle of entry as the fulcrum end of said tab fractures said first score, said arrangement further permitting said first score to be fractured along its entire length in response to a pull on the handle portion of said tab directed away from said closure.

5. A container closure having a tear strip opener in a flat planar container wall forming portion thereof comprising in combination a primary endless score line formed in said wall portion defining a tear strip; a secondary score line formed in said tear strip and terminating in terminal end portions spaced inwardly of said primary score line so as to define a collar portion between said primary and secondary score lines, said end portions of said secondary score line being turned away from an elongated pull tab; an elongated pull tab including a handle portion at one end and a fulcrum portion at the other end; and means connecting and securing said fulcrum portion of said pull tab to said collar adjacent said secondary score line so that the longitudinal axis of said pull tab extends transversely with respect to said secondary score line and the terminal end of said fulcrum portion of the pull tab is disposed adjacent a portion of said primary score line whereby lifting of the handle portion of said pull tab will effect rupture of said secondary score line, initiate rupture of said primary score line and twist the collar portion out of the plane of said wall so as to facilitate the subsequent progressive rupture of said primary score line to sever said tear strip from said wall and thereby produce an opening in said closure.

6. In an easy-opening container wall, the combination of:

a score line in the container wall defining a rupturable web in the container wall, said rupturable web defining a wall segment at least partially removable from the container wall;

a longitudinally rigid tab for initiating removal of the wall segment from the container wall, said tab having a lifting portion and a rupturing portion;

interconnecting means for attaching said tab intermediate said portions thereof to said wall segment with the rupturing portion lying closely adjacent said rupturable web whereby movement of said lifting portion of said tab away from the container wall forces said rupturing portion toward the container wall; and a line of weakness in said wall segment, said line of weakness having end portions spaced from said first rupturable web, said end portions being turned away from said rupturing portion of said tab, said interconnecting means lying between at least a portion of said line of weakness and said rupturable web whereby movement of said handle portion of said tab away from the container wall stresses and ruptures the container wall along said line of weakness to provide an aperature in said wall segment to facilitate continued movement of said handle portion of said tab, such continued movement of the handle portion causing said rupturing portion to initiate severance of said wall segment from the container wall along said rupturable web.

* * * * *